US006845536B1

(12) United States Patent
Vaidhyanathan et al.

(10) Patent No.: US 6,845,536 B1
(45) Date of Patent: Jan. 25, 2005

(54) ELECTRONIC LABELING OF HOT AND COLD FLUID SUPPLY LINES FOR AN APPLIANCE

(75) Inventors: Raveendran Vaidhyanathan, St. Joseph, MI (US); Robert R. Williams, Stevensville, MI (US); Michael A. Dirlam, St. Joseph, MI (US); George Angelov, St. Joseph, MI (US); Edward L. Thies, Creola, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 448 days.

(21) Appl. No.: 10/078,985

(22) Filed: Feb. 20, 2002

(51) Int. Cl.[7] ..... D06F 33/02

(52) U.S. Cl. ..... 8/158; 68/12.03; 68/12.12; 68/12.22; 68/208; 236/12.12

(58) Field of Search ..... 68/12.01–12.03, 68/12.12, 12.16, 12.21, 12.22, 207, 208; 8/158; 236/12.12, 12.15

(56) References Cited

U.S. PATENT DOCUMENTS 4,406,401 A * 9/1983 Nettro ..... 236/12.12
4,979,530 A 12/1990 Breda ..... 137/100
5,255,844 A 10/1993 Miller et al. ..... 236/12.12
5,873,518 A * 2/1999 Richmond et al. ..... 236/12.12
6,255,952 B1 * 7/2001 Jang ..... 340/588
6,327,730 B1 * 12/2001 Corbett ..... 8/158
6,523,370 B1 2/2003 Broker et al. ..... 68/12.21

* cited by examiner

*Primary Examiner*—Frankie L. Stinson
*Assistant Examiner*—Joseph L Perrin
(74) *Attorney, Agent, or Firm*—Robert O. Rice; Stephen Krefman; John F. Colligan

(57) ABSTRACT

Methods and system consistent with the present invention provide an appliance having inlet valves connected to respective supply lines with a control system that senses a temperature of a fluid supplied by a first of the supply lines, associates the first inlet valve connected to the first supply line with one of a plurality of predetermined temperature ranges, one of which includes the sensed temperature of the fluid in first supply line, and activates the first inlet valve upon a request by the appliance for a fluid in the one predetermined temperature range.

9 Claims, 5 Drawing Sheets

START
302
Open 1st Valve
Sense temp of fluid
304
306
Is fluid temp ≥ than "hot" set-point ?
Y
N
308
Identify valve as "hot"
310
Identify valve as "cold"
318
Open next valve
312
All valves identified?
N
316
Close 1st valve
314
Check next valve ?
Y
Y
322
Valves identified the same
Y
N
324
Activate user-perceivable signaling device
320
Identify next valve with label that is different than 1st valve
N
END

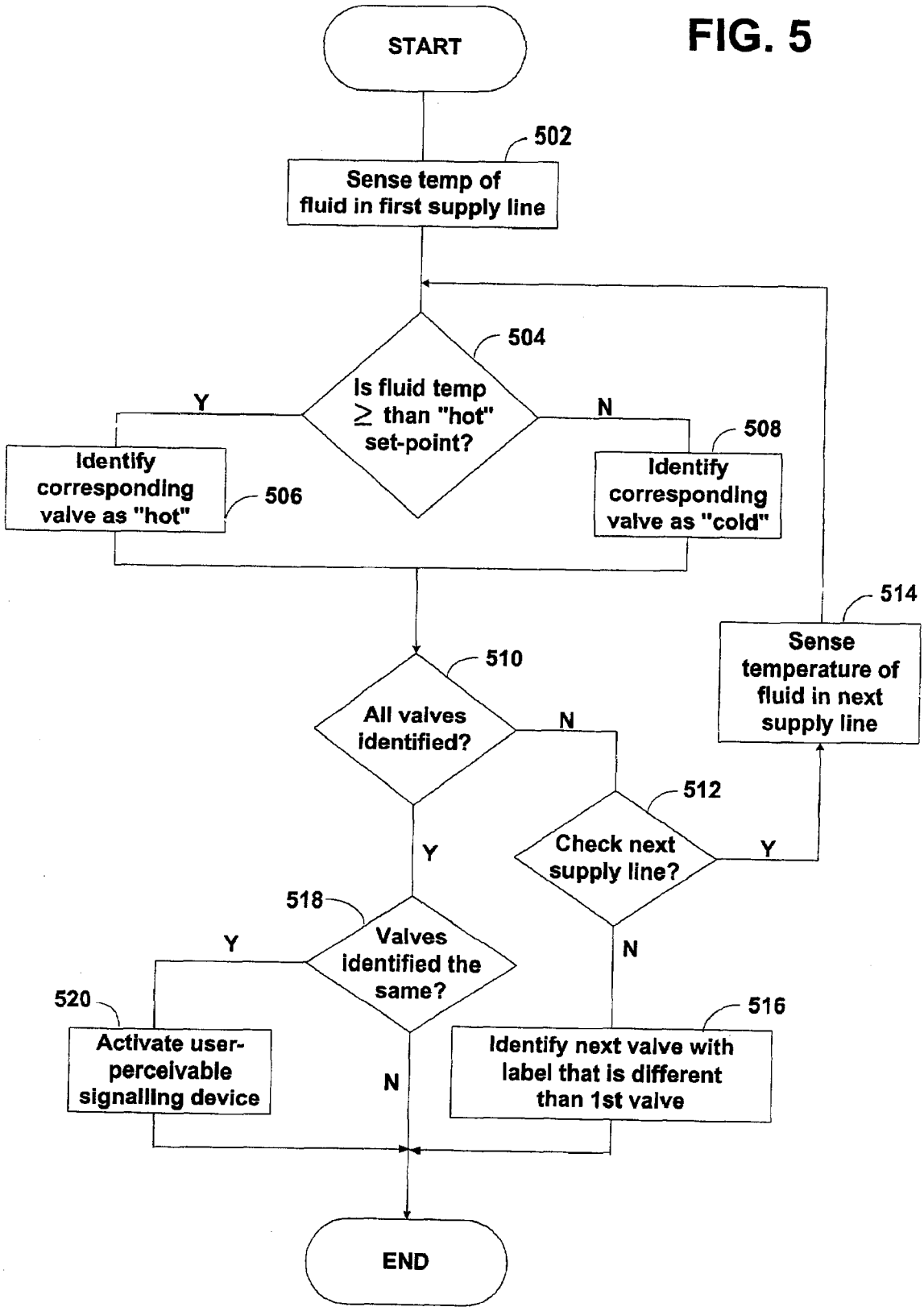
FIG. 5
START
502
Sense temp of fluid in first supply line
504
Is fluid temp ≥ than "hot" set-point?
Y
N
Identify corresponding valve as "hot"
506
508
Identify corresponding valve as "cold"
510
All valves identified?
N
Y
512
Check next supply line?
Y
N
514
Sense temperature of fluid in next supply line
518
Valves identified the same?
Y
N
520
Activate user-perceivable signalling device
516
Identify next valve with label that is different than 1st valve
END

ELECTRONIC LABELING OF HOT AND COLD FLUID SUPPLY LINES FOR AN APPLIANCE

BACKGROUND OF THE INVENTION

This invention relates to appliances and, more particularly, to appliances, such as automatic washing machines, that have a system for electronically labeling hot and cold fluid supply lines.

When installing or replacing an appliance system requiring a water supply connection, such as an automatic icemaker for a refrigerator with in the door water taps, a coffee maker with cold and hot water taps, or a clothes washer with hot and cold inlet valves, homeowners or inexperienced appliance installers often mistakenly reverse hot and cold water supply line connections to the appliance system. As a result, the appliance typically does not function properly.

A mistake in the water supply connections to a refrigerator or coffee maker can lead to a homeowner receiving hot water via a cold water tap, or vice versa. Typically, the homeowner expends time and effort in correcting the mistake or expends time and cost in calling and waiting for a service repairman to correct the mistake.

Furthermore, a homeowner may set an incorrectly connected clothes washer for a cold water cycle but because hot and cold water supply lines have been erroneously cross coupled to cold and hot water inlet valves associated with the clothes washer, the clothes washer improperly uses hot water for the cold water cycle. Thus, the error in cross coupling the water supply lines to the clothes washer leads to undesirable results when garments are washed in water that is not at the appropriate temperature (e.g., washing colored or delicate clothes in hot temperature water or washing heavily soiled cloths in cold temperature water).

Therefore, a need exits for a low cost apparatus and method for detecting a mistake in connecting hot and cold water supply lines to an appliance system such that the appliance system may not be improperly operated.

SUMMARY OF THE INVENTION

In view of the above-described circumstances, an appliance system consistent with the present invention is provided that automatically compensates for a mistake in coupling of supply lines to the appliance system by identifying each fluid supply line of the appliance system as providing hot or cold fluid, such as water, prior to or during the operation of the appliance system. To facilitate correct operation, the appliance system also alerts a user when all supply lines are identified as providing cold fluid or providing hot fluid by activating a corresponding user-perceivable signaling device.

In accordance with methods consistent with the present invention, a method is provided in a system that has an appliance and a plurality of inlet valves operably connected to the appliance. Each inlet valve is connected to a respective one of a plurality of lines supplying a fluid to the appliance. The method comprises the steps of sensing a temperature of a fluid supplied by a first of the lines connected to a first of the inlet valves, associating the first inlet valve with one of a plurality of predetermined temperature ranges where the sensed is temperature of the fluid supplied by the first line is within the one predetermined temperature range, and activating the first inlet valve upon a request by the appliance for a fluid in the one predetermined temperature range.

In accordance with articles of manufacture consistent with the present invention, a system is provided that includes an appliance and a plurality of inlet valves operably connected to the appliance. Each inlet valve is operably connected to a respective one of a plurality of lines for supplying a fluid to the appliance system. The appliance system includes a first sensing means for sensing a temperature of a fluid supplied by a first of the lines connected to a first of the inlet valves, a first identifying means operably connected to the first sensing means for identifying the first inlet valve as being associated with one of a plurality of predetermined temperature ranges when the temperature of the fluid supplied by the first line is within the one predetermined temperature range, and a control means operably connected at least the first inlet valve and to the first identifying means for activating the first inlet valve upon a request by the appliance for a fluid in the one predetermined temperature range.

In accordance with articles of manufacture consistent with the present invention, an automatic washer apparatus is provided that includes a tub to contain a wash bath, a plurality of inlet valves each operably connected to a respective one of a plurality of lines for supplying a fluid to the tub. The automatic washer apparatus also included a conduit operably connected between the plurality of inlet valves and the tub. The automatic washer apparatus also includes a first temperature sensor disposed in association with a first of the plurality of supply lines such that the first temperature sensor senses a temperature of a fluid in the first supply line, a controller operably connected to the first temperature sensor such that the controller associates a first of the inlet valves connected to the first supply line with one of a plurality of predetermined temperature ranges when the sensed temperature of the fluid supplied by the first supply line is within the one predetermined temperature range. In addition, the automatic washer apparatus includes at least one switch operably connected to the controller to selectively prompt the controller to channel to the tub a fluid in a respective one of the predetermined temperature ranges. The controller is further operably connected to the first inlet valve such that the controller activates the first inlet valve when prompted by the at least one switch for a fluid in the one predetermined temperature range associated with the first inlet valve.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings:

FIG. 5 depicts a flowchart illustrating an exemplary process that is performed by a controller in the control system in FIG. 4 to associate each supply line with a predetermined range of temperatures.

DETAILED DESCRIPTION OF THE INVENTION

An appliance system consistent with the present invention automatically compensates for incorrect coupling of supply lines to the appliance system by identifying each fluid supply line of the appliance as providing hot or cold fluid, such as water, prior to or during the operation of the appliance system. To facilitate correct operation, the appliance system also alerts a user when all supply lines are identified as providing cold fluid or providing hot fluid by activating a corresponding user-perceivable signaling device.

Figure 1:
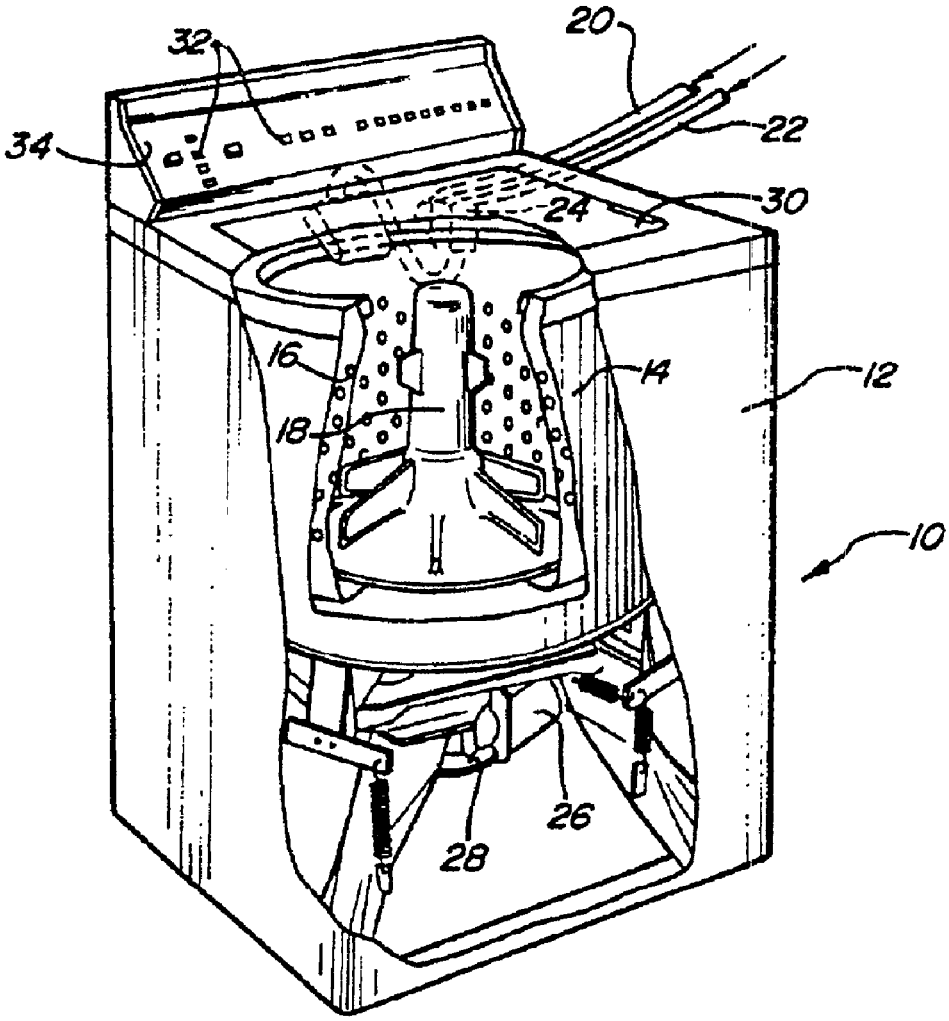
FIG. 1 is a perspective view of an automatic washer embodying the principles of the present invention partially cut away to show the interior thereof.

While the present invention may be embodied in any appliance system that has connections to multiple fluid supply lines, for clarity and understanding of the present invention the following description is limited to an exemplary automatic washing machine embodying the present invention. In FIG. 1, an automatic washing machine is shown generally at 10 comprising a cabinet or housing 12, and an imperforate tub 14, a concentrically mounted basket 16 with a vertical agitator 18, hot and cold fluid supply lines 20 22, an inlet mixing valve 24, and an electrically driven motor 26 operably connected via a transmission 28 to the agitator 18 and the basket 16. An openable lid 30 is provided on the top wall of the cabinet for access into the basket 16. Controls 32 include a presettable sequential control means for use in selectively operating the washing machine through a programmed sequence of washing, rinsing and drying steps are provided on a console panel 34. Controls 32 may also include a user-perceivable signaling device 222 shown in FIG. 2, such as a piezo-electric buzzer or a warning lamp, that may be used as described herein to alert a user of a user-only correctable mistake in connecting supply lines 20, 22 to taps 21, 23. For example, if taps 21, 23 channel both hot or both cold fluid.

Figure 2:
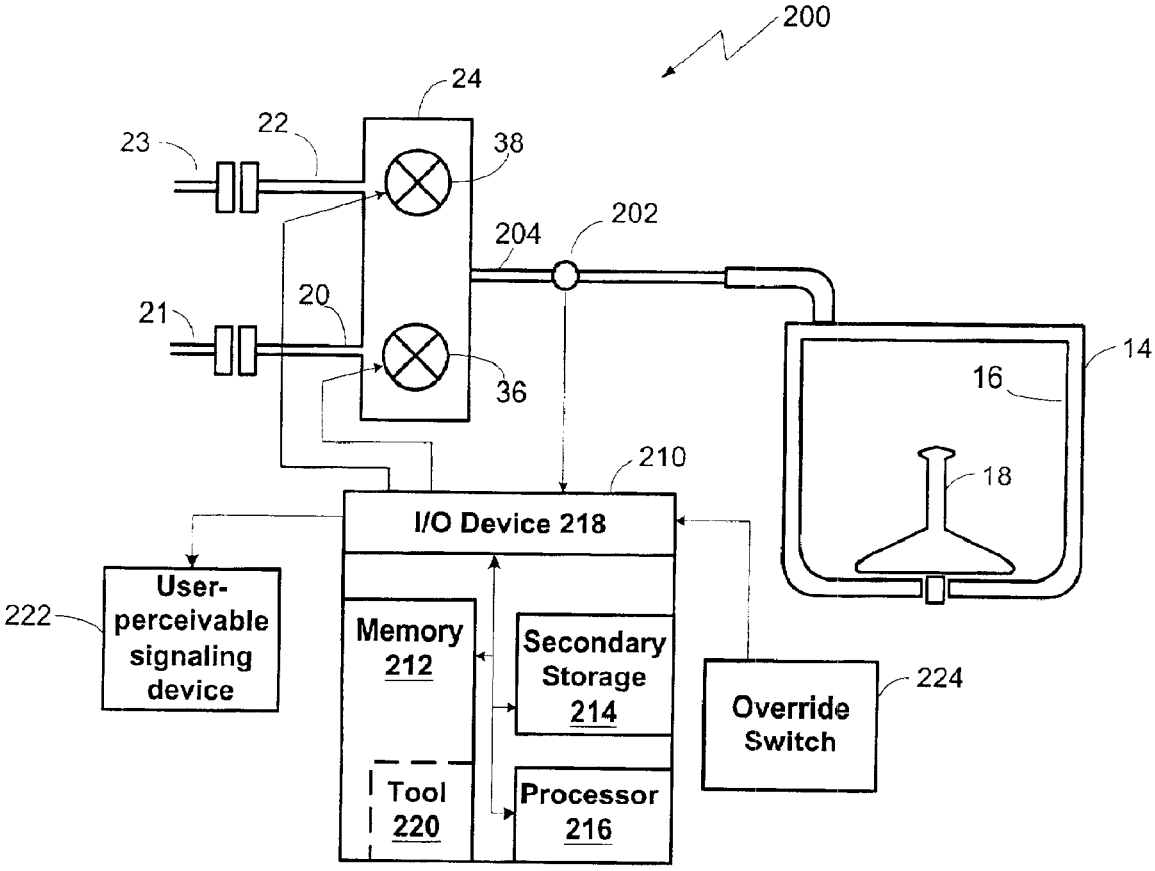
FIG. 2 is a schematic block diagram of an exemplary control system embodying the present invention.

In FIG. 2, a schematic block diagram of an exemplary control system 200 embodying the present invention is shown. The supply lines 20 and 22 are connected to a mixing valve 24 and are controlled by inlet valves 36 and 38, respectively. Water from a mixing valve 24 flows through a conduit 204 into the tub 14.

Supply lines 20 and 22 are adapted to mate with fluid connectors or taps 21 and 23, which channel hot and cold fluid such as water from respective sources (not shown in figures) within the home or building. Taps 21 and 23 may be the same standard plumbing fixture. Thus, supply lines 20 and 22 may mate with either of the taps 21 and 23. For clarity in the discussion, it is assumed that tap 21 channels hot water while tap 23 channels cold water. Thus, hot or cold fluid may be channeled through supply lines 20 and 22, depending on how the supply lines 20 and 22 are connected to taps 21 and 23.

In the embodiment shown in FIG. 2, a temperature sensor 202 is disposed in or on conduit 204. Temperature sensor 202 may be any known temperature measuring device or transducer such as a thermistor, thermocouple, resistance thermometer or commercially available IC temperature sensor. Temperature sensor 202 is operably connected (i.e., electrically or optically) to controller 210 such that controller 210 may receive a sensed temperature of a fluid in conduit 204.

In another implementation, temperature sensor 202 may be a temperature responsive switch, such as a thermostat, that opens or closes when fluid flowing through conduit 204 reaches a predetermined temperature. In this implementation, temperature sensor 202 is operably connected to controller 210 such that controller 210 may receive a switch open or close indication from temperature sensor 202 when fluid flowing through conduit 204 reaches the predetermined temperature.

The controller 210 is also operably connected to inlet valves 36 and 38 such that controller 42 may individually activate inlet valves 36 and 38 to provide a hot fluid option, a cold fluid option, or a warm fluid option for filling the tub 14 once inlet valves 36 and 38 have been electronically labeled as hot or cold as described in greater detail below. Controller 210 may include a memory 212, a secondary storage device 214, a processor 216, and an I/O device 218. Memory 212 may include a inlet valve identification tool 220, which may be a sequence of instructions to be run by the controller 220 via the processor 216. The inlet valve identification tool 220 is used by controller 210 to identify or associate each supply line 20 and 22 with a predetermined range of temperatures, such that each inlet valve 36 and 38 may be characterized as controlling a hot fluid (e.g., above 130° F.) or a cold fluid (e.g., below 80° F.). Controller 210 may store the identifications associated with inlet valves 36 and 38 in secondary storage device 214 such that the controller 210 may use the inlet valve identification tool 220 once upon power-up of the appliance 10 and thereafter read the identifications associated with inlet valves 36 and 38 from secondary storage device 214 to provide hot, warm, or cold options as requested by the user via controls 32. In one implementation, I/O device 218 of controller 210 may include a first and a second switches or relays (not shown in figures) that are operably connected to inlet valves 36 and 38, respectively. In this implementation, each inlet valve 36 and 38 may selectively be energized to an open position by the controller 210 in accordance with the identifications. One skilled in the art will recognize that controller 210 may contain additional or different components.

Although aspects of the present invention are described as being stored in memory, one skilled in the art will appreciate that these aspects can also be stored on or read from other types of computer-readable media, such as secondary storage devices, like hard disks, floppy disks or CD-ROM; a carrier wave from a network, such as Internet; or other forms of RAM or ROM either currently known or later developed.

Figure 3:
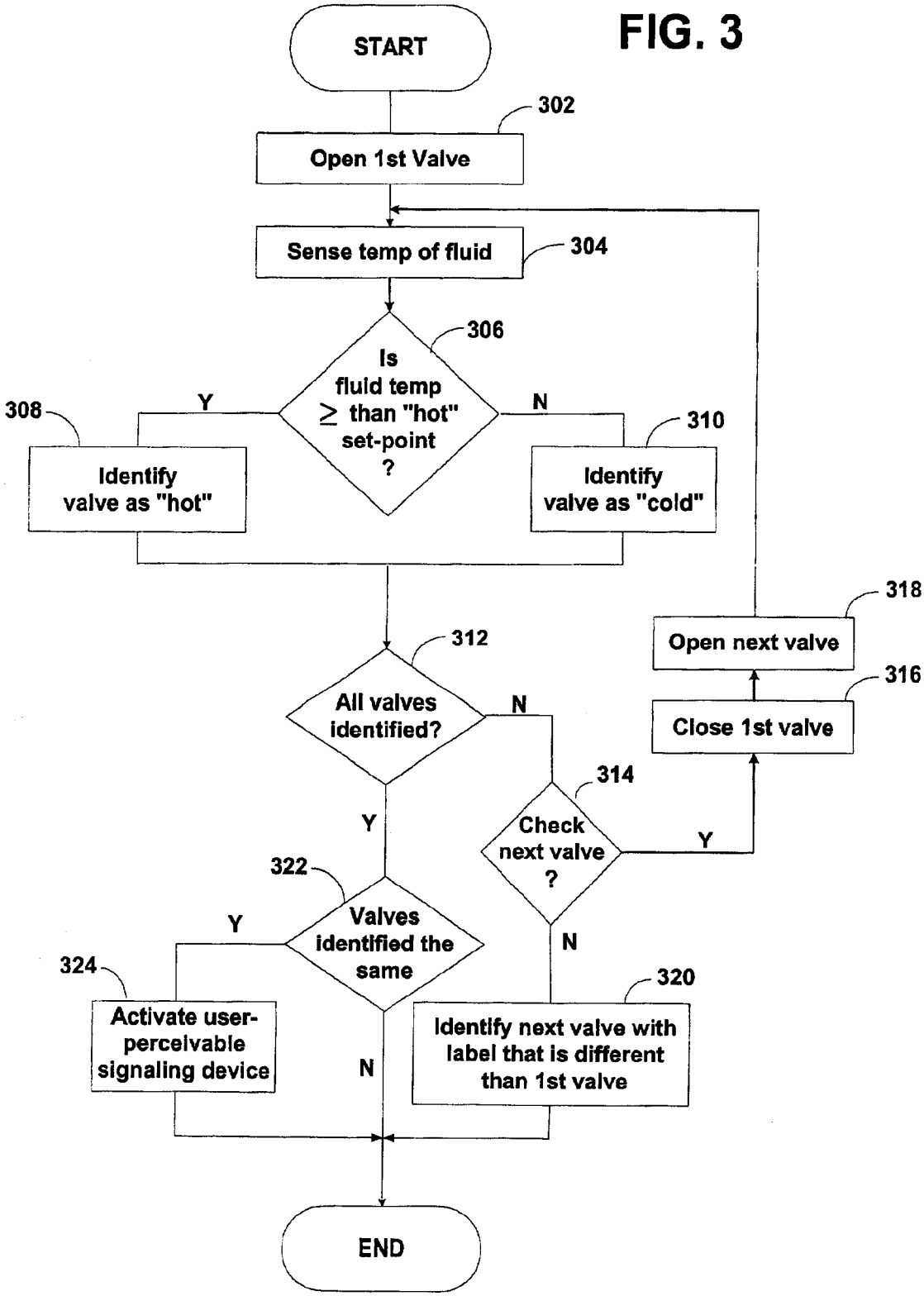
FIG. 3 depicts a flowchart illustrating an exemplary process that is performed by a controller in the control system in FIG. 2 to associate each supply line with a predetermined range of temperatures.

FIG. 3 depicts a flowchart illustrating an exemplary process corresponding to inlet valve identification tool 220 that is performed by controller 210 of control system 200 to identify or associate each supply line 20 and 22 with a predetermined range of temperatures so that each inlet valve 36 and 38 may be characterized as controlling a hot fluid (e.g., above 130° F.) or a cold fluid (e.g., below 80° F.) regardless of whether supply line 20 or 22 is its connected to tap 21 or tap 23. In the implementation shown in FIG. 3, to identify the inlet valves 36 and 38, controller 210 activates a first valve, which may be either inlet valve 36 or MATH 38 (step 302).

Next, controller 210 senses a temperature of fluid in conduit 204 via temperature sensor 202 (step 304). The fluid in conduit 204 is supplied by a respective one of supply lines 20 and 22 connected to the first inlet valve 36 or 38. Typically, fluid rests in the pathway or plumbing associated with taps 21, 23 and supply lines 20, 22 when the respective valves 36 and 38 are closed. Thus, to associate each inlet valve 36 and 38 with a predetermined range of temperatures (i.e., characterize each inlet valve as controlling hot or cold fluid), the controller 210 may wait for a predetermined time before sensing the temperature of fluid in conduit 204 so that fluid from the respective source associated with taps 21 and 23 may reach temperature sensor 202. In another implementation, controller 210 may sense the temperature of the fluid multiple times over another predetermined time and calculate an average of the sensed temperatures.

After sensing the temperature or the average temperature of fluid in conduit 204 associated with the first inlet valve 36 or 38, controller 210 determines whether the sensed temperature is greater than or equal to a predetermined temperature or "hot" set point (step 306). If the sensed temperature is greater than or equal to the "hot" set point (e.g., 130° F.), controller 210 identifies or associates the first inlet valve 36 or 38 with a predetermined temperature range that is characterized as "hot" (e.g., greater than or equal to 130° F.) (step 308). To identify the first inlet valve 36 or 38 with the predetermined temperature range, controller 210 stores a label characteristic of a hot fluid, such as "hot," "red," or other identifier in association with an identification for the first inlet valve 36 or 38. Thus, as described herein, controller 210 may thereafter activate the first inlet valve 36 or 38 upon a request by the appliance for a hot fluid or a fluid in the predetermined temperature range (e.g., user specified hot cycle option via controls 32).

If the sensed temperature is less than the "hot" set point, controller 210 identifies or associates the first inlet valve 36 or 38 with another predetermined temperature range that is characterized as "cold" (e.g., less than 130° F.) (step 310). To identify the first inlet valve 36 or 38 with the other predetermined temperature range, controller 210 stores a label characteristic of a cold fluid, such as "cold," "blue," or other identifier in association with an identification for the first inlet valve 36 or 38. Thus, as described herein, controller 210 may thereafter activate the first inlet valve 36 or 38 upon a request by the appliance for a cold fluid or a fluid in the other predetermined temperature range (e.g., user specified cold cycle option via controls 32).

In another implementation, when performing step 306, controller 210 may alternatively determine whether the sensed temperature is less than a predetermined temperature or "shot" set point before performing either of steps 308 or 310.

Next, controller 210 determines whether all inlet valves have been identified with one of the predetermined temperature ranges (step 312). If all inlet valves 36 or 38 have not been identified, controller 210 then determines whether the next or second inlet valve 36 or 38 is to be checked (step 314). Typically, once the first inlet valve is identified with one of the predetermined temperature ranges that is characterized as either "hot" or "cold," the next or second inlet valve may be assumed to be connected to a source of fluid having another one of the predetermined ranges that is different than the one predetermined temperature range associated with the first inlet valve. But it is possible that the taps 21 and 23, and thus supply lines 20 and 22, are both connected to either hot or cold fluid sources. For example, taps 21 and 23 may have been mistakenly connected to plumbing for a hot water heater in the home or building such that any connection of supply lines 20 and 22 to taps 21 and 23 results in both inlet valves 36 and 38 being identified by the controller 210 as having the same hot predetermined temperature range. Similarly, taps 21 and 23 may have been mistakenly connected to plumbing for cold water or the hot water heater may not be operational such that both inlet valves 36 and 38 are identified by controller 210 as having the same cold predetermined temperature range.

Thus, if the next or second inlet valve is to be checked, controller 210 closes the first inlet valve (step 316) and opens the next or second inlet valve (step 318). Controller 210 then continues processing at step 304 as shown in FIG. 3 to identify the next or second inlet valve 36 or 38 with another predetermined temperature range that is characteristic of a hot or a cold fluid.

If the next or second inlet valve 36 or 38 is not to be checked, controller 210 associates the next or second inlet valve 36 or 38 with another predetermined temperature range that is different than the predetermined range associated with the first inlet valve (step 320). Thus, assuming the first inlet valve 36 or 38 is identified by controller 210 as associated with a predetermined temperature range that is characteristic of a hot fluid, than controller 210 associates the second inlet valve 36 or 38 with a different predetermined temperature range that is characteristic of a cold fluid. Thus, in this example, controller 210 may thereafter activate the second inlet valve 36 or 38 upon a request by the appliance for a cold fluid or a fluid in the different predetermined temperature range (e.g., user specified cold cycle option via controls 32).

If all inlet valves have been identified, controller 210 then determines whether the inlet valves have the same identification (step 322). Thus, controller 210 checks if inlet valves 36 and 38 have each been associated with the predetermined temperature range that is characteristic of a hot fluid or the predetermined temperature range that is characteristic of a cold fluid. If inlet valves 36 and 38 have the same identification, then controller 310 activates user-perceivable signaling device 222 to alert a user both inlet valves 36 and 38 channel both hot or both cold fluid (step 324). In another implementation, user-perceivable signaling device 222 may be one of multiple user-perceivable signaling devices 222 such that one alerts a user that inlet valves 36 and 38 both channel hot fluid and another alerts a user that inlet valves 36 and 38 both channel cold fluid.

In one implementation, in addition to activating the user-perceivable signaling device, controller 210 may disable controls 32 to prevent improper operation of appliance 10 due to the identified mistake or error in connecting inlet valves 36 and 38 to both hot or cold sources. In this implementation, controls 32 may include an override switch 224 shown in FIG. 2 that is operably connected to controller 210. When actuated override switch 224 prompts the controller 210 to enable controls 32 and to identify one of the two inlet valves 36 and 38 with cold fluid and the other with hot fluid so that the appliance 10 remains operational despite the identified mistake or error.

One disadvantage to control system 200 is that by locating temperature sensor 202 in or on conduit 204, fluid channeled through at least the first inlet valve 36 or 38 when the process depicted in FIG. 3 is performed by controller 210 reaches tub 14. Thus, in one implementation, the appliance 10 may need to drain this fluid from tub 14 before responding to user selections via controls 32. In another implementation, the appliance 10 may continue to operate in response to user selections via controls 32 without draining this fluid because the amount of fluid in tub 14 is not significant relative to the amount of fluid to be added to tub 14 for a user selected wash cycle.

Figure 4:
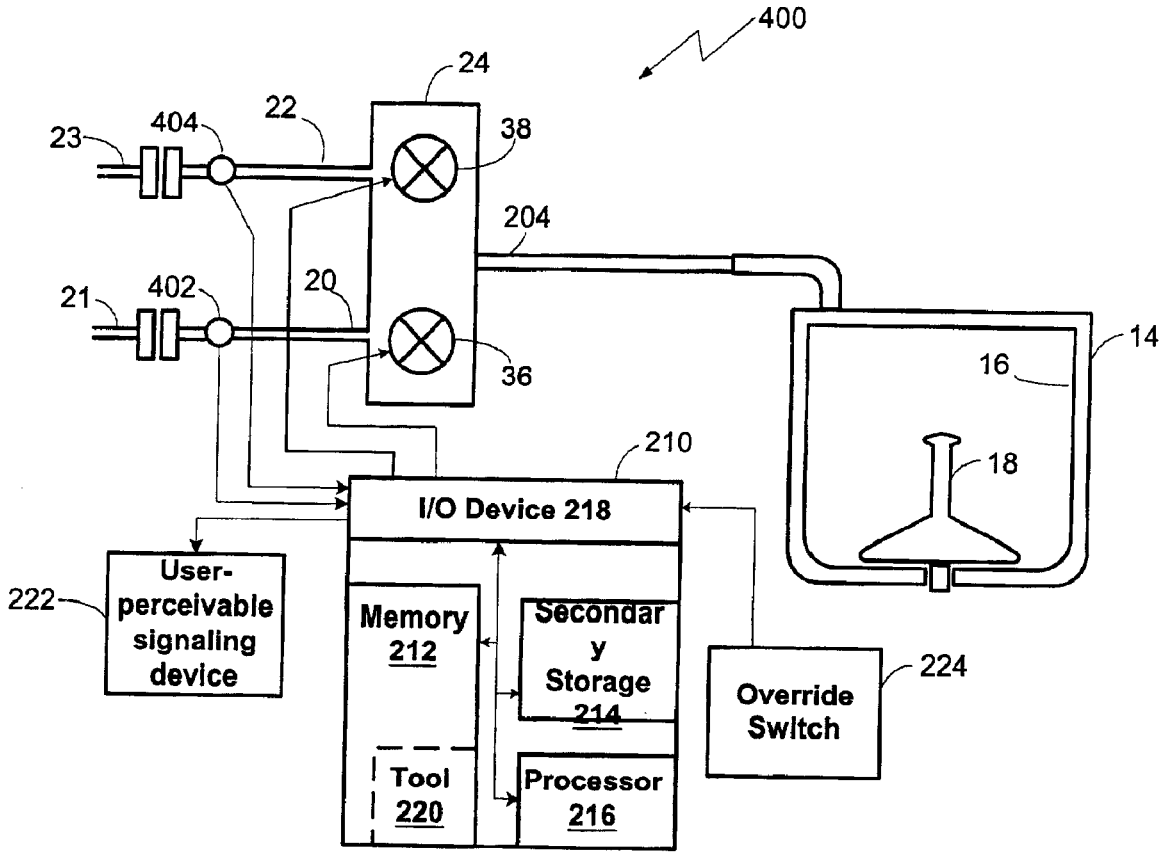
FIG. 4 is a schematic block diagram of another exemplary control system embodying the present invention.

FIG. 4 depicts a schematic block diagram of another exemplary control system 400 embodying the present invention. As shown in FIG. 4, control system 400 includes temperature sensors 402 and 404 located in or on supply lines 402 and 404, respectively. Temperature sensors 402 and 404, however, may be located within mixing valve 24 between the respective supply lines 20 and 22 and the respective inlet valves 36 and 38. Temperature sensors 402 and 404 are operably connected (i.e., electrically or optically) to controller 210 such that controller 210 may receive a sensed temperature of a fluid in respective supply lines 20 and 22. Temperature sensors 402 and 404 may otherwise be identical and operate the same as temperature sensor 202 in FIG. 2.

FIG. 5 depicts a flowchart illustrating another exemplary process corresponding to inlet valve identification tool 220 that is performed by controller 210 of control system 400 to identify or associate each supply line 20 and 22 with a predetermined range of temperatures so that each inlet valve 36 and 38 may be characterized as controlling a hot fluid or a cold fluid regardless of whether supply line 20 or 22 is connected to tap 21 or tap 23.

In the implementation shown in FIG. 5, controller 210 first senses a temperature of fluid in a first supply line associated with a first inlet valve (step 502). The first supply line may be either supply line 20 or 22 in FIG. 4, which are connected to inlet valves 36 and 38, respectively. Controller 210 senses the temperature of the fluid in the first supply line 20 or 22 via the respective temperature sensor 402 and 404. In one implementation, the respective temperature of fluid in supply lines 20 and 22 may be sensed simultaneously by controller 210.

Controller 210 may also sense the temperature of fluid in either supply lines 20 and 22 without activating the respective inlet valve 36 and 38. Therefore, when the process depicted in FIG. 5 is performed by controller 210, fluid does not reach tub 14. Thus, the appliance 10 may respond to user selections via controls 32 without draining tub 14.

As described above, fluid may rest in the pathway or plumbing associated with taps 21, 23 and supply lines 20, 22 when the respective valves 36 and 38 are closed. Thus, to associate each inlet valve 36 and 38 with a predetermined range of temperatures (i.e., characterize each inlet valve as controlling hot or cold fluid), the controller 210 may wait for a predetermined time before sensing the temperature of fluid in the first supply line 20 or 22 so that fluid from the respective source associated with taps 21 and 23 may reach the respective temperature sensor 402 and 404. In another implementation, controller 210 may sense the temperature of the fluid in the first supply line 20, 22 multiple times over another predetermined time and calculate an average of the sensed temperatures.

After sensing the temperature or the average temperature of fluid in the first supply line 20 or 22 associated with the first inlet valve 36 or 38, controller 210 determines whether the sensed temperature is greater than or equal to a predetermined temperature or "hot" set point (step 504). If the sensed temperature is greater than or equal to the "hot" set point (e.g., 130° F.), controller 210 identifies or associates the first inlet valve 36 or 38 with a predetermined temperature range that is characterized as "hot" (e.g., greater than or equal to 130° F.) (step 506). To identify the first inlet valve 36 or 38 with the predetermined temperature range, controller 210 stores a label characteristic of a hot fluid, such as "hot" or "red," in association with an identification for the first inlet valve. Thus, as described herein, controller 210 may thereafter activate the first inlet valve 36, 38 upon a request by the appliance for a hot fluid or a fluid in the predetermined temperature range (e.g., user specified hot cycle option via controls 32).

If the sensed temperature is less than the "hot" set point, controller 210 identifies or associates the first inlet valve with another predetermined temperature range that is characterized as "cold" (step 508). To identify the first controller with the other predetermined temperature range, controller 210 stores a label characteristic of a cold fluid, such as "cold" or "blue," in association with an identification for the first inlet valve. Thus, as described herein, controller 210 may thereafter activate the first inlet valve 36, 38 upon a request by the appliance for a cold fluid or a fluid in the other predetermined temperature range (e.g., user specified cold cycle option via controls 32).

Next, controller 210 determines whether all inlet valves have been identified with one of the predetermined temperature ranges (step 510). If all inlet valves have not been identified, controller 210 then determines whether the next or second inlet valve 36 or 38 is to be checked (step 512). Typically, once the first inlet valve 36 or 38 is identified with one of the predetermined temperature ranges that is characterized as either "hot" or "cold," the next or second inlet valve 36 or 38 may be assumed to be connected to a source of fluid having another one of the predetermined ranges that is different than the one predetermined temperature range associated with the first inlet valve.

But, as previously discussed, it is possible that the taps 21 and 23, and thus supply lines 20 and 22, are both connected to either hot or cold fluid sources. For example, taps 21 and 23 may each have been mistakenly connected to plumbing lines for a hot water heater in the home or building such that any connection of supply lines 20 and 22 to taps 21 and 23 results in both inlet valves 36 and 38 being identified by the controller 210 as having the same hot predetermined temperature range. Similarly, taps 21 and 23 may have each been mistakenly connected to plumbing lines for cold water or the hot water heater may not be operational such that both inlet valves 36 and 38 are identified by controller 210 as having the same cold predetermined temperature range.

Thus, if the next or second inlet valve is to be checked, controller 210 senses a temperature of fluid in a next or second supply line 20 or 22 associated with a next or second inlet valve 36 or 38 (step 516). Controller senses a temperature of fluid in the next supply line 20 or 22 via the respective temperature sensor 402 or 404. Controller 210 then continues processing at step 504 as shown in FIG. 5 to identify the next or second inlet valve 36 or 38 with another predetermined temperature range that is characteristic of a hot or a cold fluid.

If the next or second inlet valve is not to be checked, controller 210 associates the next or second inlet valve with another predetermined temperature range that is different than the predetermined range associated with the first inlet valve (step 516). Thus, assuming the first inlet valve 36 or 38 is identified by controller 210 as associated with a predetermined temperature range that is characteristic of a hot fluid, then controller 210 associates the next inlet valve 36 or 38 with a different predetermined temperature range that is characteristic of a cold fluid. Thus, in this example, controller 210 may thereafter activate the next inlet valve 36 or 38 upon a request by the appliance for a cold fluid or a fluid in the different predetermined temperature range (e.g., user specified cold cycle option via controls 32).

If all inlet valves have been identified, controller 210 then determines whether the inlet valves 36 and 38 have the same label or identification (step 518). Thus, controller 210 checks if inlet valves 36 and 38 have each been associated with the predetermined temperature range that is characteristic of a hot fluid or the predetermined temperature range that is characteristic of a cold fluid. If inlet valves 36 and 38 have the same identification, then controller 310 activates user-perceivable signaling device 222 to alert a user both inlet valves 36 and 38 channel both hot or both cold fluid (step 520).

As previously discussed, in addition to activating the user-perceivable signaling device, controller 210 may disable controls 32 to prevent improper operation of to appliance 10 due to the identified mistake or error in connecting inlet valves 36 and 38 to both hot or cold sources. In this implementation, controls 32 may include an override switch 224 that is operably connected to controller 210. When actuated override switch 224 prompts the controller 210 to enable controls 32 and to identify one of the two inlet valves 36 and 38 with cold fluid and the other with hot fluid so that the appliance 10 remains operational despite the identified mistake or error.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. The method in a system having an appliance and a plurality of inlet valves operably connected to the appliance, each inlet valve is connected to a respective one of a plurality of lines supplying a fluid to the appliance, the method comprising the steps of:

sensing a temperature of a fluid supplied by a first of the lines connected to a first of the inlet valves;

associating the first inlet valve with one of a plurality of predetermined temperature ranges, the sensed temperature of the fluid supplied by the first line being within the one predetermined temperature range;

activating the first inlet valve upon a request by the appliance for a fluid in the one predetermined temperature range;

sensing a temperature of a fluid supplied by a second of the lines connected to a second of the inlet valves;

associating a second of the plurality of inlet valves with another of the plurality of predetermined temperature ranges, the sensed temperature of the fluid supplied by the second line being within the other predetermined temperature range;

activating the second inlet valve upon a request by the appliance for a fluid in the other predetermined temperature range; and determining whether the one predetermined temperature range associated with the first inlet valve is the same as the other predetermined temperature range associated with the second inlet valve; and activating a user-perceivable signaling device in response to determining that the one predetermined temperature range is the same as the other predetermined temperature range.

2. The method in claim 1, where the step of activating the first inlet valve further comprises the step of activating the first inlet valve upon the request by the appliance when it is determined that the one predetermined temperature range associated with the first inlet valve is not the same as the other predetermined temperature range associated with the second inlet valve.

3. A system having an appliance and having a plurality of inlet valves operably connected to the appliance, each inlet valve operably connected to a respective one of a plurality of lines for supplying a fluid to the appliance system, the appliance system comprising:

a first sensing means for sensing a temperature of a fluid supplied by a first of the lines connected to a first of the inlet valves;

a first identifying means operably connected to the first sensing means for identifying the first inlet valve as being associated with one of a plurality of predetermined temperature ranges when the temperature of the fluid supplied by the first line is within the one predetermined temperature range;

a control means operably connected at least the first inlet valve and to the first identifying means for activating the first inlet valve upon a request by the appliance for a fluid in the one predetermined temperature range;

a second sensing means for sensing a temperature of a fluid supplied by a second of the lines connected to a second of the inlet valves, the first identifying means is operably connected to the second sensing means for identifying the second inlet valve as being associated with another of a plurality of predetermined temperature ranges when the temperature of the fluid supplied by the second line is within the other predetermined temperature range, the control means is operably connected to the first identifying means for activating the second inlet valve upon a request by the appliance for a fluid in the other predetermined temperature range;

a user-perceivable signaling device operably connected to the control means, and wherein the control means further comprises: a means for determining whether the one predetermined temperature range associated with the first inlet valve is the same as the other predetermined temperature range associated with the second inlet valve; and a means for activating the user-perceivable signaling device in response to determining that the one predetermined temperature range is the same as the other predetermined temperature range.

4. The system in claim 3, wherein the control means further comprises a means for disabling the first and the second inlet valves in response to determining that the one predetermined temperature range associated with the first inlet valve is the same as the other predetermined temperature range associated with the second inlet valve.

5. The system in claim 4, further comprising an override switch operably connected to the disabling means towards prompting the same to allow at least one of the first and the second inlet valves to be activated upon a request from the appliance for a fluid in one of the predetermined temperature ranges.

6. An automatic washer apparatus having a tub to contain a wash bath, a plurality of inlet valves each operably connected to a respective one of a plurality of lines for supplying a fluid to the tub, and a conduit operably connected between the plurality of inlet valves and the tub, the automatic washer apparatus comprising:

a first temperature sensor disposed in association with a first of the plurality of supply lines such that the first temperature sensor senses a temperature of a fluid in the first supply line;

a controller operably connected to the first temperature sensor such that the controller associates a first of the inlet valves connected to the first supply line with one of a plurality of predetermined temperature ranges when the sensed temperature of the fluid supplied by the first supply line is within the one predetermined temperature range;

at least one switch operably connected to the controller to selectively prompt the controller to channel to the tub a fluid in a respective one of the predetermined temperature ranges, the controller being further operably connected to the first inlet valve such that the controller activates the first inlet valve when prompted by the at least one switch for a fluid in the one predetermined temperature range associated with the first inlet valve;

a second temperature sensor disposed in association with a second of the plurality of supply lines such that the second temperature sensor senses a temperature of a fluid in the second supply line, the controller is operably connected to the second temperature sensor such that the controller associates a second of the inlet valves connected to the second supply line with another of the plurality of predetermined temperature ranges when the sensed temperature of the fluid supplied by the second supply line is within the other predetermined temperature range, the controller is further operably connected to the second inlet valve such that the controller activates the second inlet valve when prompted by the at least one switch for a fluid in the other predetermined temperature range associated with the second inlet valve; and a user-perceivable signaling device operably connected to the controller such that the controller activates the user-perceivable signaling device in response to determining that the one predetermined temperature range associated with the first inlet valve is the same as the other predetermined temperature range associated with second inlet valve.

7. The automatic washer apparatus in claim 6, wherein the controller prevents activation of the first and the second inlet valves upon determining that the one predetermined temperature range associated with the first inlet valve is the same as the other predetermined temperature range associated with second inlet valve.

8. The automatic washer apparatus in claim 7, further comprising an override switch operably connected to the controller towards prompting the same to allow at least one of the first and second inlet valves to be activated in response to a prompt from the at least one switch for a fluid in one of the plurality of predetermined temperature ranges.

9. The automatic washer apparatus in claim 6, further comprising an override switch operably connected to the controller towards prompting the same to allow at least one of the second inlet valves to be activated in response to a prompt from the at least one switch for a fluid in one of the plurality of predetermined temperature ranges.

* * * * *